United States Patent [19]

Podrapsky

[11] 4,401,096

[45] Aug. 30, 1983

[54] MAGNETO IGNITION SYSTEM FOR AN INTERNAL COMBUSTION ENGINE

[75] Inventor: Jiri Podrapsky, Rosstal, Fed. Rep. of Germany

[73] Assignee: Robert Bosch GmbH, Stuttgart, Fed. Rep. of Germany

[21] Appl. No.: 424,255

[22] Filed: Sep. 27, 1982

[30] Foreign Application Priority Data

Jan. 20, 1982 [DE] Fed. Rep. of Germany ..... 3201534

[51] Int. Cl.[3] ..... F02P 1/00

[52] U.S. Cl. ..... 123/631; 123/149 R; 123/149 C

[58] Field of Search ..... 123/601, 602, 603, 599, 123/631, 149 R, 149 A, 149 C, 149 D; 315/209 T

[56] References Cited

U.S. PATENT DOCUMENTS 3,824,976 7/1974 Katsumata ..... 123/149 R
3,878,452 4/1975 Haubner ..... 315/209 T
4,188,929 2/1980 Podradsky ..... 123/599
4,329,950 5/1982 Oroua ..... 123/599

*Primary Examiner*—Ronald B. Cox
*Attorney, Agent, or Firm*—Frishauf, Holtz, Goodman & Woodward

[57] ABSTRACT

To prevent reverse-direction operation of an internal combustion (IC) engine to which the ignition system is connected which, possibly, may lead to dangerous conditions if the IC engine is used, for example in a chain saw, lawn mower, or the like, a diode (35) is connected across a second, ignition instant modifying R/C circuit (34, 33) in the control network (29) of the magneto ignition system, which includes a first R/C circuit (30, 31) to provide for immediate conduction of a control transistor (27) and hence blocking of a controlled ignition transistor (21) and disconnection of the ignition system in case of reverse rotation. This system is a further development of the basic ignition system described in U.S. Pat. No. 4,188,929, to which reference is made.

7 Claims, 5 Drawing Figures

MAGNETO IGNITION SYSTEM FOR AN INTERNAL COMBUSTION ENGINE

The present invention relates to a magneto ignition system for an internal combustion (IC) engine, and more particularly to a magneto ignition system for small engines, for example for use with chain saws, lawn mowers, or the like, in which a magnetic element rotating with the shaft of the internal combustion engine induces a voltage in the primary winding of an induction coil, electromagnetically coupled to the rotating magnet, current through which is interrupted at an ignition instant by an electronic switch.

BACKGROUND

Magneto ignition systems of the type described in the referenced U.S. Pat. No. 4,188,929 have been found eminently suitable for small internal combustion (IC) engines, particularly in those in which space is at a premium. In many such engines, there is insufficient room for special ignition timing transducers. The magneto generator is thus frequently connected to a fan or ventilator wheel on the IC engine, by embedding permanent magnets in the rotating fan wheel, formed with two pole shoes, which are magnetically coupled to an armature secured to the housing of the IC engine. As described in the referenced patent, the armature is wound on a core which carries both a primary and secondary winding, the secondary winding being connected to a spark plug, and the primary winding being connected to a control network which includes an ignition transistor. The ignition transistor is controlled to conduction or blocking state by a control circuit which includes a control transistor.

The ignition transistor which, preferably, is a Darlington transistor, is controlled to block by the control transistor at the ignition instant. The control transistor has its base connected to a circuit which includes a Zener diode, as well as two R/C networks which are timing networks to control the ignition instant. A first series R/C circuit generally determines the ignition instant, and a second series R/C circuit, connected in parallel thereto, is provided to control change of the ignition instant with change in speed of the engine, typically by advancing the ignition at high speed.

It has been found that this system, which is eminently suitable for small engines, under some operating conditions, not reliably prevent reverse operation of the engine. This, however, is desirable for safety reasons if an ignition system with such an engine is coupled to a utilization device which should operate in only one direction, for example a chain saw or a lawn mower. Engines driving such appliances should reliably prevent reverse direction operation within a relatively wide range of speed.

THE INVENTION

It is an object to improve the basic circuit described in the referenced U.S. Pat. No. 4,188,929 such that, upon possible reverse rotation of the engine, ignition is reliably prevented, so that the engine will operate in only one direction.

Briefly, the circuit described in U.S. Pat. No. 4,188,929 is modified to insure operation of the engine in a predetermined direction only by connecting a diode in parallel with the timing circuit which modifies the timing relationship of the ignition timing instant in accordance with engine speed. This diode is poled in a direction opposite to the polarization of the Zener diode used in the primary series R/C circuit controlling the ignition instant. The second timing circuit has one of its terminals connected to that one of the terminals of the primary winding of the armature which, at the ignition instant, has a voltage which is high with respect to the other terminal.

In accordance with a preferred feature of the invention, the timing constant of the series R/C circuit which shifts the timing instant in accordance with engine speed has a time constant which is at least ten times that of the series R/C circuit primarily determining the ignition instant. The capacity value of the series R/C circuit primarily determining the ignition instant is preferably about half that of the capacity of the modifying timing circuit; and the resistance value of the resistance component of the primary timing circuit is about 230 times that of the resistance of the modifying timing circuit.

The ignition system has the advantage that reverse rotation operation of internal combustion engines equipped with such a circuit is effectively prevented. The system has the additional advantage that this safety enhancement can be obtained with hardly any additional circuit requirements, and with only relatively minor changes in the circuit arrangement, so that existing structural arrangements and space requirements for circuit components need not be modified.

DRAWINGS

Figure 1:
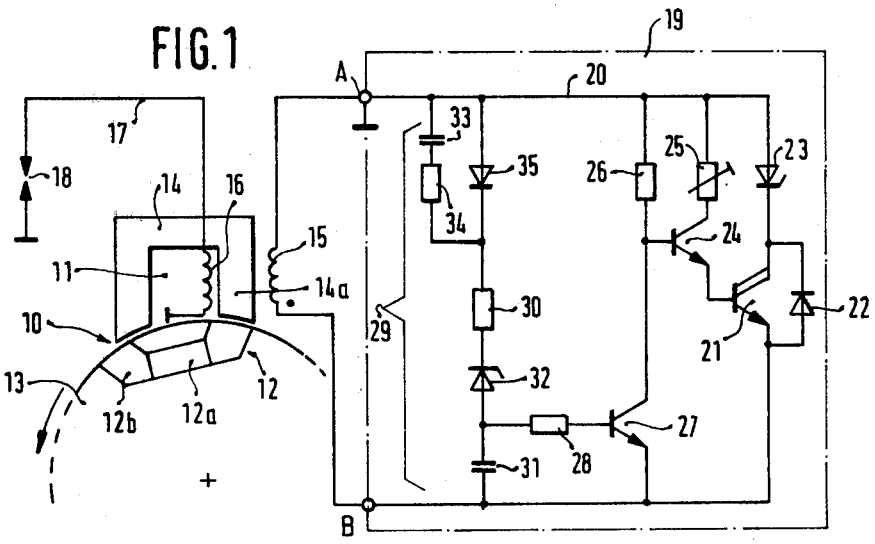
FIG. 1 is a circuit diagram of the ignition system with a magneto generator to generate ignition energy.

The basic circuit of FIG. 1 corresponds to that described in the referenced U.S. Pat. No. 4,188,929. The invention will be described in connection with an example of an ignition system for a 1-cylinder internal combustion (IC) engine to drive a chain saw. The ignition system receives electric energy over a magneto 10, having an armature 11 which is located in magnetic induction with a rotary magnetic system 12, for example formed by a permanent magnet embedded in the flywheel or a cooling fan wheel of the engine (not shown). The magneto system 12 has a permanent magnet 12 and two pole shoes **12*b*, located at the circumference of a rotary element driven by the IC engine, for example being embedded therein. The armature 11 is secured to the housing of the IC engine and simultaneously forms the ignition coil of the ignition system. The armature 11 includes a U-shaped core 14. The core 14 is generally U-shaped and the primary winding 15 is wound on the leading leg 14*a* thereof. The secondary winding 16 likewise is wound over the leading leg. The secondary winding 16 is connected over an ignition cable 17 with spark plug 18 of the IC engine. The primary winding 15 is connected to terminals A and B of the ignition control system, which forms a primary network 20. The system 19, preferably, is constructed in form of a hybrid circuit and potted together with the primary and secondary winding in the armature unit 11. The primary circuit 20 includes an npn ignition transistor 21, formed as a Darlington switching transistor. The ignition transistor 21 has its emitter connected to the terminal B of the primary winding 15. Its switching path is bridged by a diode 22, poled to be conductive for reverse voltages applied to the ignition transistor. The collector terminal of the ignition transistor 21 is connected over a Zener diode 23, having a Zener voltage of about 15 V, with the terminal A of the primary winding 15. The basis of the ignition transistor 21 is connected to the emitter of an npn driver transistor 24, the collector of which is connected through a resistor 25 of controllable resistance to terminal A. The base of the driver transistor 24 is connected over resistance 26 with the terminal A, and further to the collector of an npn control transistor 27, the emitter of which is connected to terminal B. The base of the control transistor 27 is connected over a resistor 28 to a circuit network 29 connected to the primary current circuit 20**.

The network 29 provides the timing for the ignition instant. Network 29 has a first R/C network formed by the series resistance of the resistor 30 of, for example, 130 ohms, and a capacitor 31 of, for example, 33 nF. The capacitor 31 has one terminal connected to terminal B, the other to the resistor 28 and hence to the base of the control transistor 27, and additionally to the anode terminal of a Zener diode 32, the cathode of which is connected to the resistor 30. The Zener diode 31 has a Zener breakdown voltage of 2.6 V. The circuit branch 29, further, has a second R/C network including a capacitor 33 and a resistor 34. The capacitor 33, for example, has a capacity of 68 nF, and the resistor 34 has a resistance of 30 kilo ohms.

In accordance with the invention, a diode 35 is connected between the resistor 30 and the terminal A, and the second series R/C circuit 34, 33 is connected across the diode. The capacitor 33 of the second R/C circuit is connected to terminal A. The diode has a passing polarity opposite that of the Zener diode 32.

Terminal A is connected to ground or chassis of the engine, so that one terminal of the capacitor 33, forming part of the second series R/C circuit, and the anode of the diode 35, as well as one of the terminals of the primary winding 15 are connected to ground or chassis, via terminal A.

Figure 2:
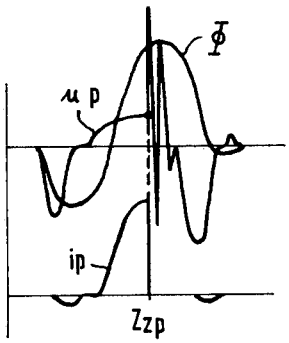
FIG. 2 is a diagram of magnetic flux, primary voltage and primary current at proper, or normal direction of rotation, with respect to time.
Figure 3:
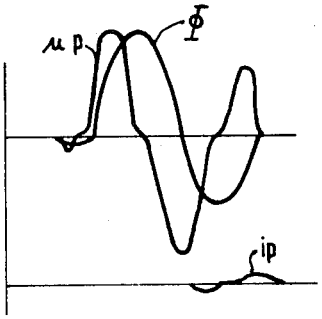
FIG. 3 is a diagram similar to FIG. 2, but with reverse, improper, or prohibited direction of rotation of the engine.

Operation, with reference to FIGS. 2 and 3: Let it be assumed that the engine has been started, for example by a pull starter or the like, to operate in proper and predetermined direction. This direction is indicated by the arrow adjacent the rotary element 13 carrying the magnet system 12. The course of the magnetic flux phi is shown in FIG. 2 with respect to time. Flux changes during the ignition instant, or at the ignition event itself, have been neglected.

Based on the course of the flux, and considering the terminal B as the reference, the primary winding 15 will have a first negative voltage half-wave generated therein, which drives a primary current over the circuit network 29, as well as over the diode 22 connected in parallel to the ignition transistor 21, and through the Zener diode 23. This primary current $i_p$ is small. The capacitor 31 of the first R/C network 30, 31 as well as the capacitor 33 of the second R/C network are negatively precharged. The control transistor 27 as well as the driver transistor 24 and the ignition transistor 21 are blocked.

Upon beginning of the subsequent positive half-wave, the primary current controls the driver transistor 24 to become conductive over resistor 26; the ignition transistor 21 is then also controlled to conduction, abruptly, over transistor 25 and the collector-emitter or main current carrying path of the driver transistor 24. The primary current $i_p$ will become phase shifted and flow through the ignition transistor 21. As soon as the primary voltage has reached the threshold level of the Zener diode 32 in the network 29, capacitors 33 and 31 are recharged in opposite direction. The second R/C series network 34, 33 is bridged by the diode 35; the first R/C network 30, 31 is so dimensioned that the capacitor 31, upon the primary current becoming a maximum, is charged to a value which switches over the control transistor 27 into conductive state. This occurs at the ignition timing instant Zzp, and thus shunting, at the ignition instant, the control paths of the driver transistor 24 and of the ignition transistor 21. Consequently, driver and ignition transistors 24, 21 will block, and primary current $i_p$ will be abruptly interrupted. This causes a high voltage pulse to occur in the stationary winding 16 which is transferred over the ignition cable 17 to the spark plug 18 to cause a spark.

During the ignition event, that is, during sparking, a voltage oscillation will occur in the primary winding 15 which terminates in the negative voltage half-wave caused by rotation of the magnet 12 with respect to the armature 11. This oscillation, however, is ineffective as far as the ignition system is concerned.

The above process repeats with each passage of a magnetic system 12 before the armature 11, for example upon each rotation of the rotary element, e.g. the fan or cooling wheel of the engine. In normal, ordinary direction of rotation, thus, the network 29 controls the ignition instant of the ignition system 19.

If, for example, due to malfunction, a kick-back or the like, the direction of rotation of the engine should be reversed, the course of the magnetic flux will be as illustrated in FIG. 3. At first, the primary winding will be subjected to a small half-wave causing a small half-wave voltage. The two R/C series circuits within the network 29 are so dimensioned that this initial negative voltage half-wave, with a peak value of about 1 V, can charge the capacitor 31 of the first R/C series circuit only to a voltage of about 0.3 volts in a negative direction. This insures that, upon beginning of the subsequent positive half-wave of the primary voltage $U_p$, capacitor 31 will be rapidly charged over the diode 35, resistor 30, and Zener diode 32—so rapidly that the control transistor 27 is controlled to conduction over the resistor 28 already before the phase-shifted primary current $i_p$ begins to flow. The primary current, again, is phase-shifted with respect to the primary voltage. Conduction of the control transistor causes blocking of the driver transistor 24 and of the ignition transistor 21. This blocks the primary current circuit 20, and no ignition event can take place.

The subsequent negative half-wave of the primary voltage charges the capacitors 31 and 33 in the network 29 in a negative direction. These capacitors are recharged, however, by the subsequent positive smaller half-waves of the primary voltage. The primary current half-wave, driven by this last half-wave of the primary voltage, can flow over the ignition transistor 21, but is ineffective as far as the ignition system is concerned. The current level is too small to provide useful energy, and the timing of this last primary voltage half-wave is so late that, even at higher speeds, an ignition event which might occur will be so late that the engine cannot start, or continue to run in reverse direction.

The secondary R/C circuit, and the diode 35, as well as the primary R/C circuit, can be connected in the network 29 in various ways.

Figure 4:
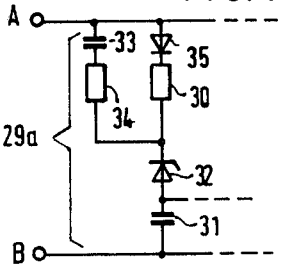
FIG. 4 is a fragmentary diagram illustrating a modification of the circuit of FIG. 1.

Embodiment of FIG. 4: The network 29*a* has the same circuit elements 30 to 35; the diode 35, however, is bridged by the second series R/C circuit 34, 33 together with the resistor 30 of the first R/C circuit.

Figure 5:
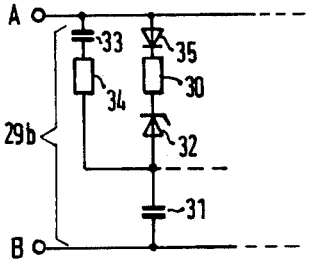
FIG. 5 is a fragmentary diagram illustrating yet another modification.

Embodiment of FIG. 5: The diode 35, the resistor 30 of the first R/C circuit 30, 31, and the Zener diode 32 are all bridged by the second R/C circuit 34, 33, as seen in network 29*b*. Functionally and operationally, the circuits of FIGS. 1, 4 and 5 are equivalent.

In accordance with a feature of the invention, the two R/C series circuits in the networks 29, 29*a*, 29*b* are so dimensioned that, upon reverse or incorrect direction of rotation, the capacitor 31 is slightly negatively precharged by the first negative primary half-wave, so that the control transistor 27 will be controlled to conduction by the subsequent positive primary voltage half-wave already before or, at the latest, upon beginning of the flow of the phase-shifted primary current half-wave. The second series R/C circuit 34, 33 should be so dimensioned that, at proper speed of rotation, the ignition instant is shifted only as desired, but not undesirably so. Both conditions can readily be realized by so arranging the timing constant of the second R/C circuit 33, 34, so that it has at least ten times the timing value of the first R/C circuit 30, 31. Further, the capacity of the capacitor 31 of the first R/C circuit 30, 31 is about half that of the capacitor 33 of the second R/C circuit; and the resistance of the resistor 30 of the first R/C circuit is about 1/230 (=0.0043) times that of the resistance of resistor 34 of the second R/C circuit. The foregoing values are only approximate, and suitable, for example, for a small magneto generator for use with a chain saw; various changes and modifications may be made within the scope of the inventive concept. For example, and referring to FIG. 5, the second series circuit 34/33 can be connected to bridge only the diode 35 and the Zener diode 32, with the resistor 30 being connected as in FIG. 1, except that, of course, the Zener diode 32 is placed as shown in FIG. 5.

I claim:

1. Magneto ignition system for an internal combustion engine having a spark gap, said system including an ignition coil system having a primary winding (15);

two terminals (A, B) on the primary winding;

a secondary winding (16);

an armature core (14, 14*a*) and a rotating magnet (12) coupled to rotate with the engine;

an electronic switch (21) connected to interrupt current flow through the primary winding at an ignition instant;

an electronic control circuit (29) coupled to the primary winding and connected to control conduction or blocking of the electronic switch (21) and having a control switch (27);

a first R/C series timing circuit (30, 31) connected to said control switch (27) and across the primary winding, a Zener diode serially connected in said first R/C series circuit, and a second series R/C circuit (34, 33) to modify the conduction characteristic of the first timing circuit and provide a change of timing instant as a function of frequency of voltages induced in the primary winding, and hence provide for speed-dependent ignition advance, said timing circuits controlling said control switch (27);

and comprising, in accordance with the invention, means for insuring operation of the engine in a predetermined direction only including a diode (35) connected in parallel to the second timing circuit (34, 33), the diode (35) being poled in a direction opposite to the polarization of the Zener diode (32);

and wherein the second timing circuit (34, 33) has one of its terminals connected to that one of terminals (A) of the primary winding (15) which, at the ignition instant, has a voltage which is high with respect to the other terminal (B) thereof.

2. System according to claim 1, wherein the timing constant of the second series R/C circuit (34, 33) is at least ten times that of the timing constant of the first series R/C circuit (30, 31).

3. System according to claim 1, wherein the capacity of the capacitor of the first series R/C circuit (30, 31) is about half that of the capacity of the capacitor (33) of the second R/C circuit (34, 33);

and the resistance (30) of the first R/C circuit (30, 31) is about 1/230 (=0.0043) times the resistance of the resistor (34) of the second R/C circuit (34, 33).

4. System according to claim 1, wherein the capacitor (33) of the second series R/C circuit (34, 33) and the anode of the diode (35) are commonly connected to said one terminal (A) of the primary winding (15);

and wherein said one terminal (A) is connected to ground or chassis connection of the system and of the engine.

5. System according to claim 1, wherein (FIG. 4) the diode (35) and the resistor (30) of the first R/C circuit (30, 31) form a series sub-circuit, and said series sub-circuit is bridged by the second series R/C circuit (34, 33).

6. System according to claim 1, wherein (FIG. 5) the diode (35), the resistor (30) of the first series R/C circuit (30, 31) and the Zener diode (32) form a first series branch circuit;

and the second R/C circuit (34, 33) is connected across said branch circuit.

7. System according to claim 1, wherein (FIG. 5) the diode (35) and the Zener diode (32) form a common series sub-circuit;

and wherein the second series R/C circuit (34, 33) is connected across said series sub-circuit.

* * * * *